US008860269B2

(12) United States Patent
Choi et al.

(10) Patent No.: US 8,860,269 B2
(45) Date of Patent: Oct. 14, 2014

(54) WATERTIGHT APPARATUS FOR AN UNDERWATER MOTOR

(75) Inventors: Hyeung-sik Choi, Busan (KR); Han-il Park, Busan (KR)

(73) Assignee: Korea Maritime University R&DB Foundation, Busan (KR)

( * ) Notice: Subject to any disclaimer, the term of this patent is extended or adjusted under 35 U.S.C. 154(b) by 330 days.

(21) Appl. No.: 13/498,901

(22) PCT Filed: Aug. 13, 2010

(86) PCT No.: PCT/KR2010/005340

§ 371 (c)(1),
(2), (4) Date: Mar. 28, 2012

(87) PCT Pub. No.: WO2011/040705

PCT Pub. Date: Apr. 7, 2011

(65) Prior Publication Data

US 2012/0187788 A1 Jul. 26, 2012

(30) Foreign Application Priority Data

Sep. 29, 2009 (KR) ..... 10 2009 0092379

(51) Int. Cl.
*H02K 5/10* (2006.01)

(52) U.S. Cl.
USPC ..... 310/87; 310/88

(58) Field of Classification Search
USPC ..... 310/87, 88, 89
See application file for complete search history.

(56) References Cited

U.S. PATENT DOCUMENTS 4,940,911 A * 7/1990 Wilson ..... 310/87
6,100,616 A * 8/2000 Heinig et al. ..... 310/87

FOREIGN PATENT DOCUMENTS

| | | | |
|---|---|---|---|
| EP | 0043162 | A1 | 1/1982 |
| JP | 10-205495 | A | 8/1998 |
| JP | 2000-227091 | A | 8/2000 |
| JP | 2004-245134 | A | 9/2004 |

OTHER PUBLICATIONS

Machine translation for JP 2004-245134A Apr. 12, 2014.*
International Search Report for PCT/KR2010/005340 filed Aug. 13, 2010.

* cited by examiner

*Primary Examiner* — Hanh Nguyen

(57) ABSTRACT

The present invention relates to a watertight apparatus for an underwater motor, comprising a double oil jacket for preventing high-pressure water from entering the underwater motor along a rotary shaft of the underwater motor. According to the present invention, high-pressure water is prevented from entering the underwater motor along the rotary shaft of the underwater motor even in the case of mechanical devices which operate in deep water, thereby preventing failure in the operation of or damage to mechanical devices caused by the ingress of water. In addition, the oil jacket can be easily replaced, thereby enabling the effective performance of maintenance and repair of mechanical devices.

7 Claims, 8 Drawing Sheets

WATERTIGHT APPARATUS FOR AN UNDERWATER MOTOR

TECHNICAL FIELD

The present invention relates to an underwater motor watertight apparatus configured to prevent the inflow of high-pressure water along the rotation shaft of an underwater motor.

BACKGROUND ART

Underwater motors constitute core components that drive most mechanical devices operating in underwater environments. Any exposure to water may cause the underwater motors, which include electric and mechanical parts, to malfunction or degrade seriously. Therefore, watertightness of underwater motors is crucial to prevent such problems. Specifically, in the case of mechanical devices operating in deep water, high-pressure water is likely to flow in along the rotation shaft of underwater motors, greatly increasing the necessity to design a structure to prevent such inflow of high-pressure water.

DISCLOSURE

Technical Problem

Therefore, the present invention has been made in view of the above-mentioned problems, and an aspect of the present invention is to provide an underwater motor watertight apparatus having double oil jackets configured to prevent the inflow of high-pressure water along the rotation shaft of an underwater motor.

Technical Solution

In accordance with an aspect of the present invention, there is provided an underwater motor watertight apparatus including: an outer oil jacket forming a sealing space surrounding a rotation shaft of a motor; and an inner oil jacket forming an additional sealing space additionally surrounding the rotation shaft of the motor inside the sealing space, wherein respective sealing spaces are filled with oil to prevent inflow of water into a body of the motor.

Advantageous Effects

The underwater motor watertight apparatus according to the present invention prevents inflow of high-pressure water along the rotation shaft of an underwater motor, even in the case of a mechanical device operating in deep water, thereby removing any possibility that the mechanical device may malfunction or degrade due to inflow of water. Furthermore, the easy process of oil jacket replacement makes maintenance and repair of the mechanical device efficient.

BRIEF DESCRIPTION OF THE DRAWINGS

The foregoing and other objects, features and advantages of the present invention will become more apparent from the following detailed description when taken in conjunction with the accompanying drawings in which.

DESCRIPTION OF MAJOR REFERENCE NUMERALS IN THE DRAWINGS

Figure 1:
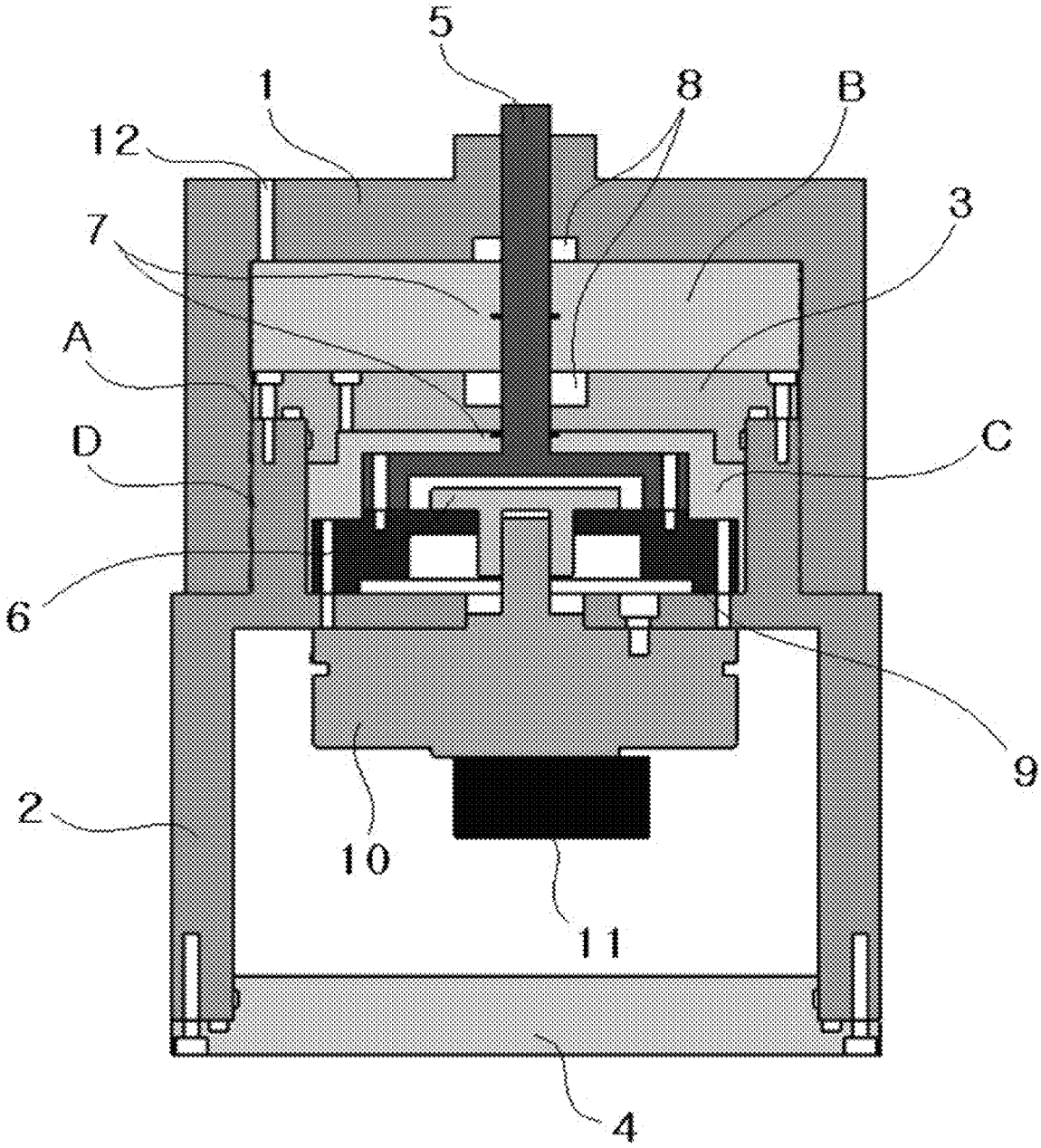
FIG. 1 illustrates an underwater motor watertight apparatus according to the present invention.

1: outer oil jacket
2: case
3: inner oil jacket
4: lower cover
5: rotation shaft
6: connection shaft
7: snap ring
8: bearing
9: harmonic driver
10: motor
11: encoder
12: oil injection hole Best Mode Mode for Invention The present invention will now be described in detail with reference to FIG. 1.

An underwater motor watertight apparatus according to the present invention includes an outer oil jacket 1 forming a sealing space B surrounding a rotation shaft 5 of a motor 10 and an inner oil jacket 3 forming an additional sealing space C additionally surrounding the rotation shaft 5 of the motor 10 inside the sealing space B. Respective sealing spaces B and C are filled with oil to prevent inflow of water into the body of the motor 10.

Figure 5:
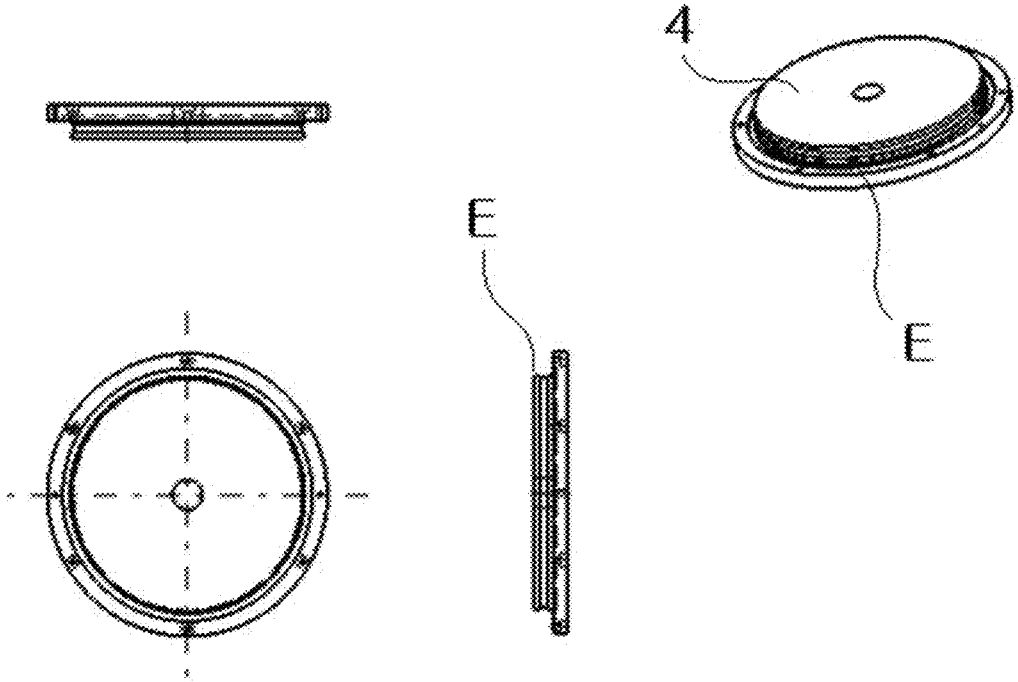
FIG. 5 illustrates the shape of a lower cover.
Figure 6:
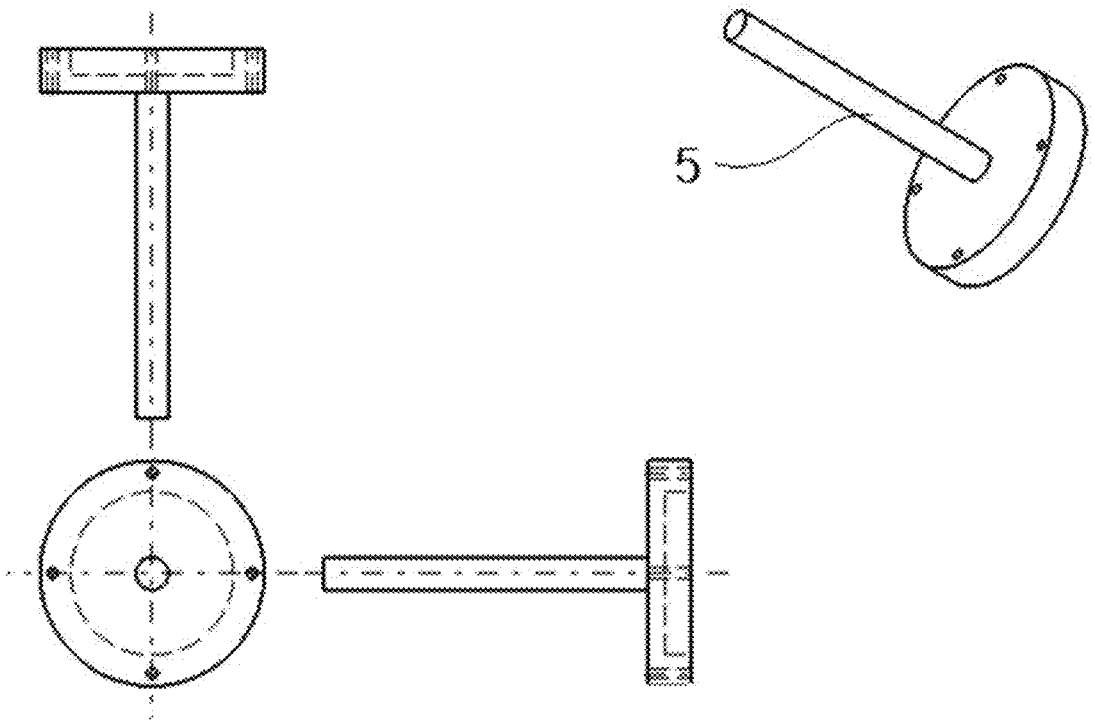
FIG. 6 illustrates the shape of a rotation shaft.
Figure 7:
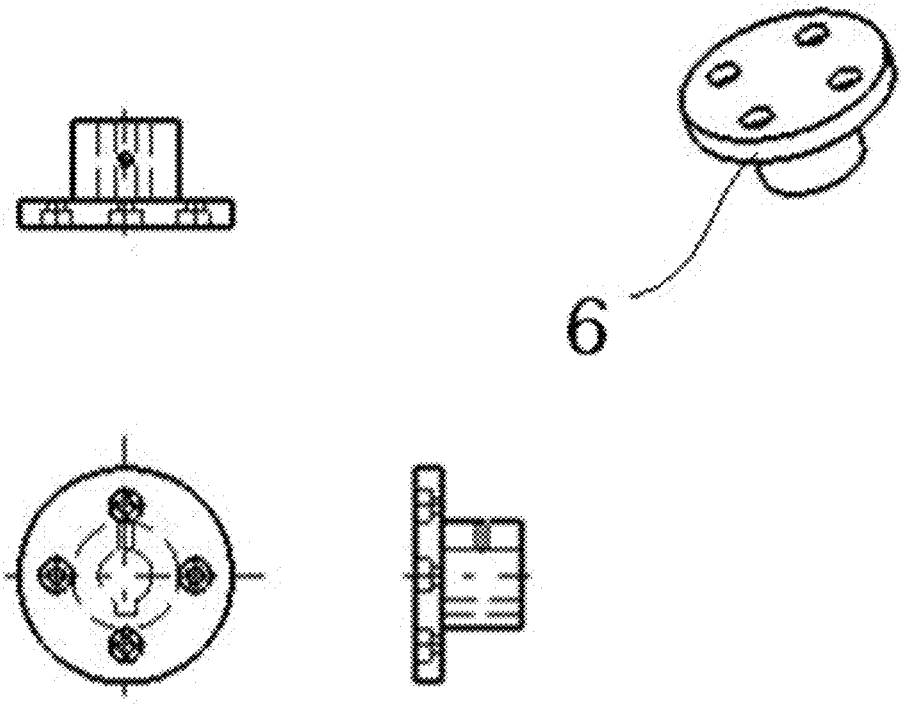
FIG. 7 illustrates the shape of a connection shaft.
Figure 8:
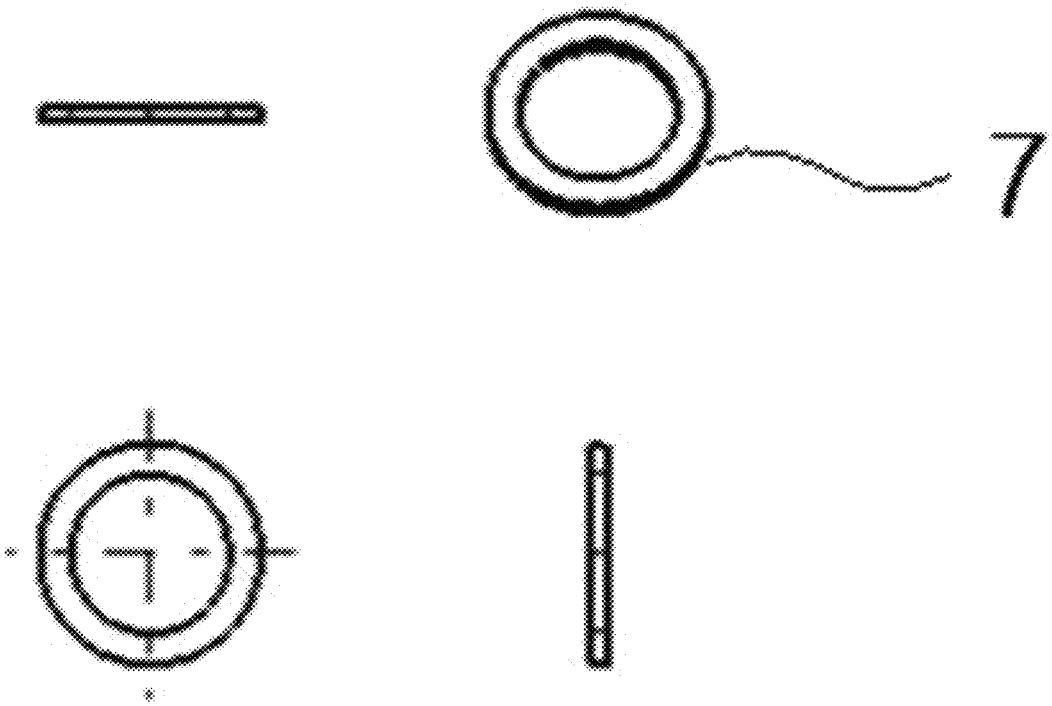
FIG. 8 illustrates the shape of a snap ring.
Figure 9:
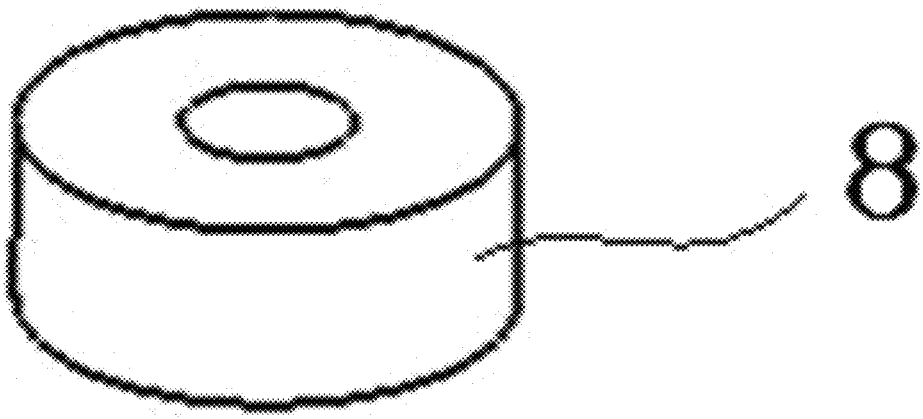
FIG. 9 illustrates the shape of a bearing.
Figure 10:
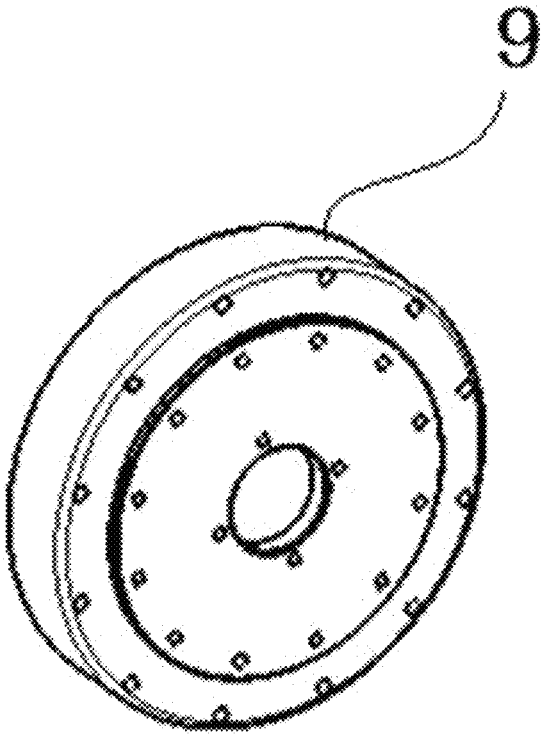
FIG. 10 illustrates the shape of a harmonic driver.
Figure 11:
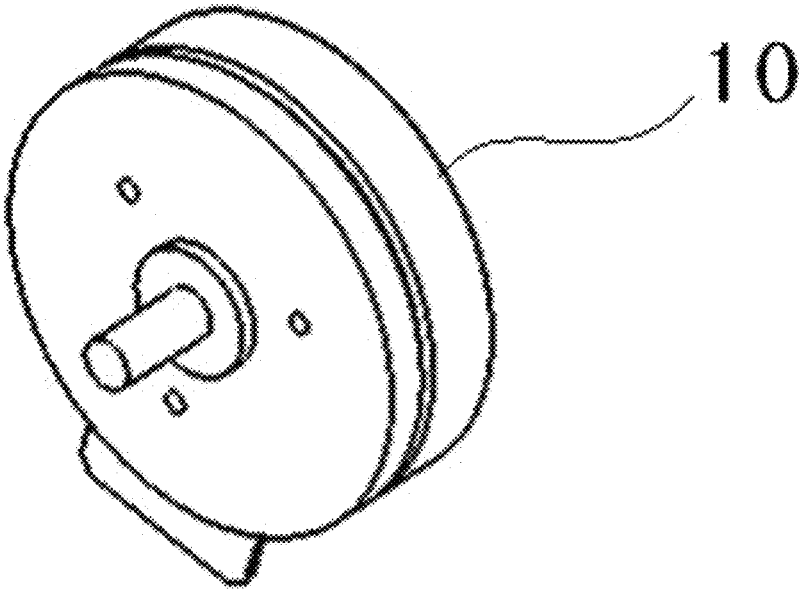
FIG. 11 illustrates the shape of a motor.
Figure 12:
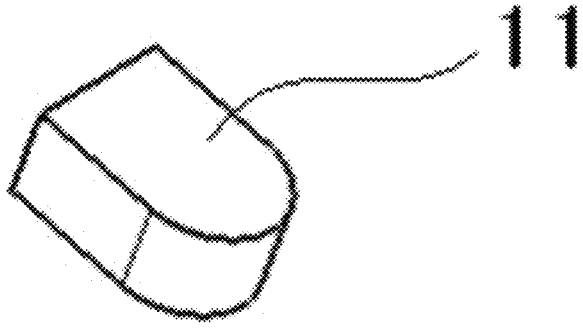
FIG. 12 illustrates the shape of an encoder.

The motor 10 and an encoder 11 are mounted inside a case 2, and a lower cover 4 is attached beneath the case 2, thereby forming a sealing space. The case 2 has a cylindrical shape, and a screw thread is formed on the upper outer peripheral surface D of the case 2 to be fastened with the outer oil jacket 1. The lower cover 4 has an O-ring insertion part E (FIG. 5) formed to provide waterproofing. The motor 10 extends through the upper surface of the case 2 and connects to a harmonic driver 9.

A connection shaft 6 connects the harmonic driver 9 to the rotation shaft 5. The harmonic driver 9 is a reducer configured to reduce the rate of rotation of the motor 10 and increase torque.

Figure 13:
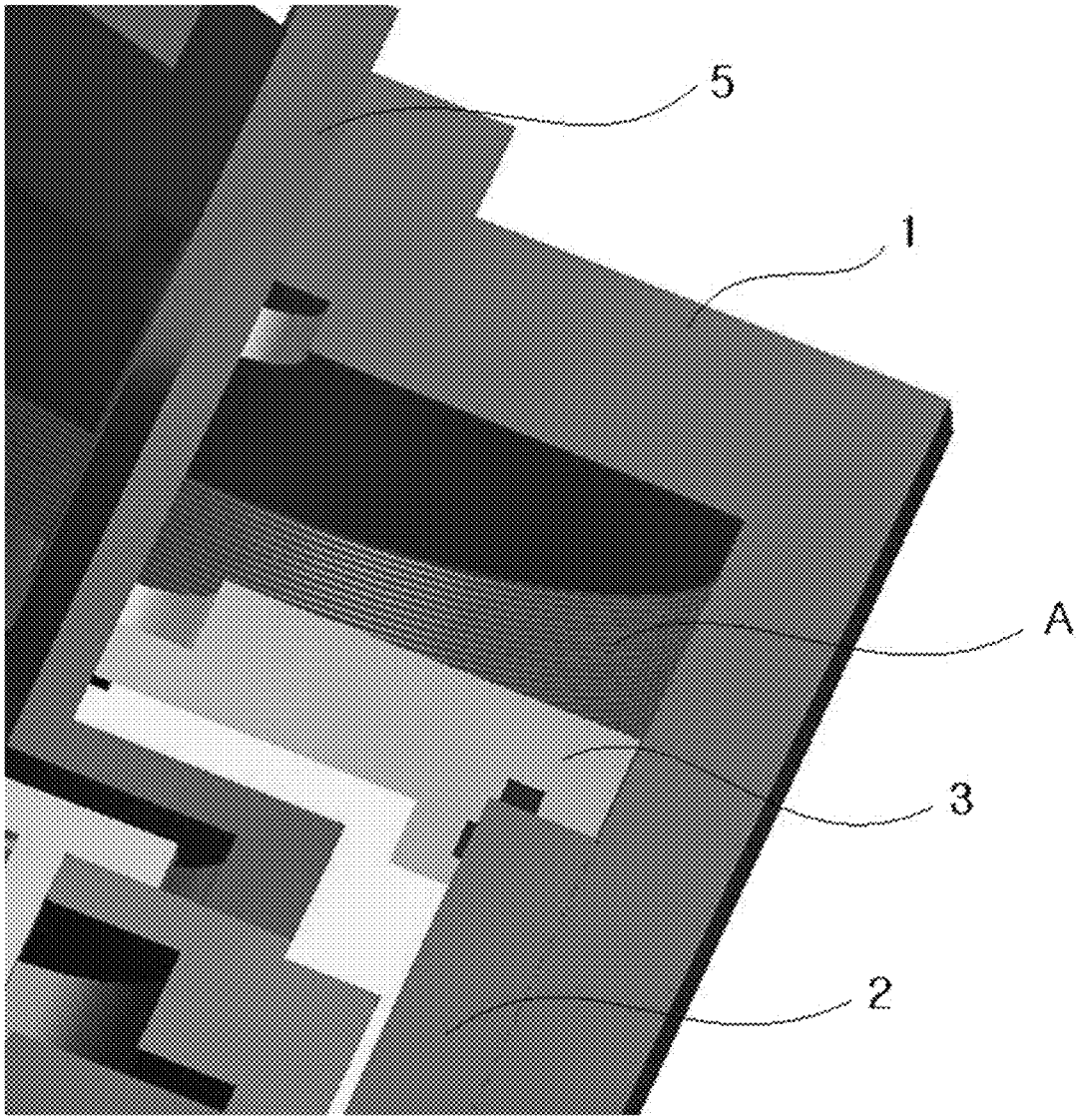
FIG. 13 illustrates the formation of a screw thread on the inner wall surface of the outer oil jacket.

The cylindrical outer oil jacket 1 is fastened to the upper outer peripheral surface D of the case 2. A screw thread (FIG. 13) is formed on the inner wall surface A of the outer oil jacket 1, and a screw thread is formed on the upper outer peripheral surface D of the case 2, so that the screw threads of the outer oil jacket 1 and the case 2 engage each other as male and female screws. Therefore, the outer oil jacket 1, when rotated clockwise, is easily fastened to the case 2. Counterclockwise rotation of the outer oil jacket 1, on the other hand, separates the outer oil jacket 1 from the case 2. As such, the present invention employs a thread structure enabling easy attachment/detachment of the outer oil jacket 1 to/from the case 2 and guarantees that, even if the outer oil jacket 1 is corroded by unexpected inflow of water, the operator can easily replace oil or repair the device accordingly.

Figure 2:
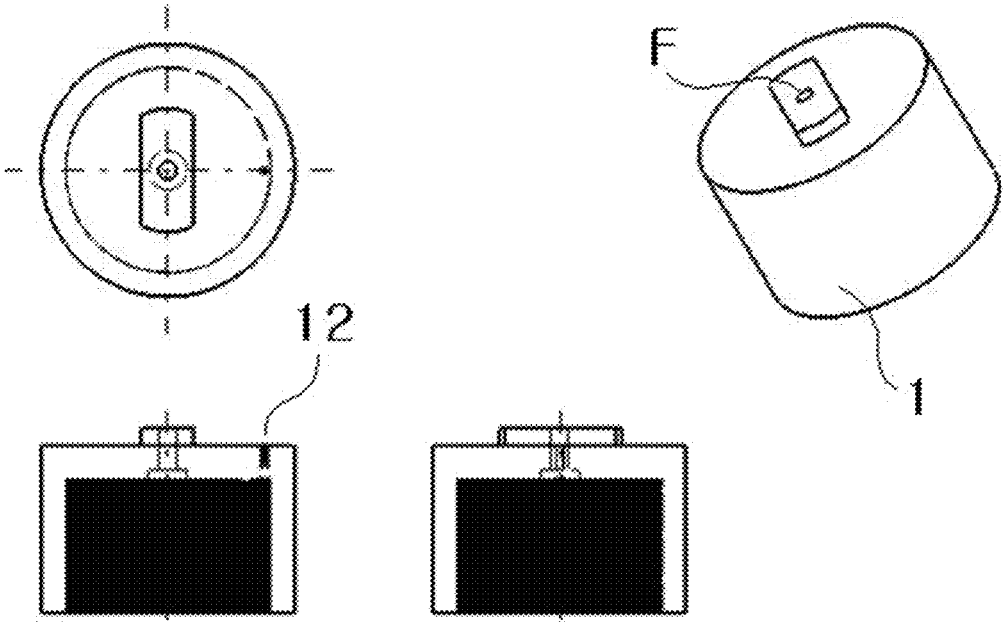
FIG. 2 illustrates the shape of an outer oil jacket.
Figure 3:
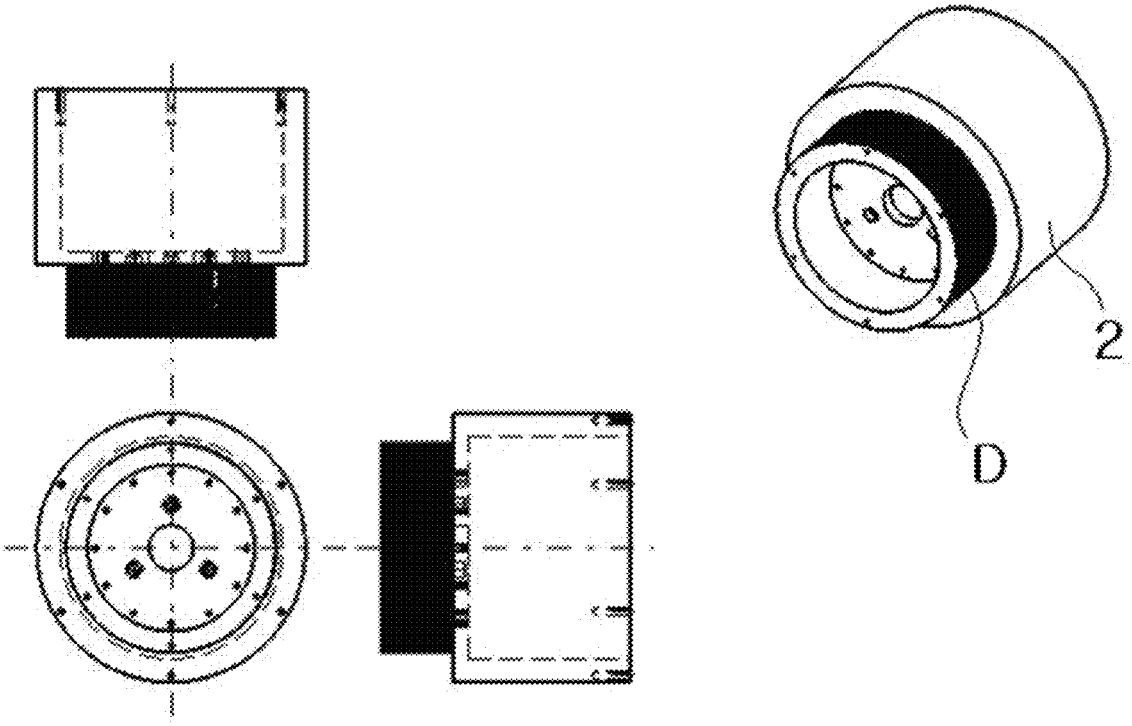
FIG. 3 illustrates the shape of a case.

The outer oil jacket 1, which is fastened to the case 2, forms a sealing space B surrounding the rotation shaft 5 of the motor 10. The outer oil jacket 1 has a hole F (FIG. 2) formed at the center of its upper surface so that the rotation shaft 5 extends through the hole F. In other words, the outer oil jacket 1 surrounds the rotation shaft 5 while the rotation shaft 5 extends through the outer oil jacket 1. The sealing space B formed by the outer oil jacket 1 contains the rotation shaft 5, the connection shaft 6, and the harmonic driver 9. The sealing space B is filled with oil. Specifically, the oil has excellent resistance to water and wear and good anti-rusting properties. The resulting oil pressure in the sealing space B guarantees that, even if the outer oil jacket 1 is subjected to water pressure in underwater environments, water is not allowed to easily flow into the sealing space B.

Meanwhile, the outer oil jacket 1 has an oil injection hole 12 formed on its upper surface so that oil is injected through the oil injection hole 12 to fill the sealing space B with oil. The oil injection hole 12 is closed by a bolt after the sealing space B is fully filled with oil. According to the present invention, the oil injection hole 12 is positioned at the outermost periphery from the center of the outer oil jacket 1 so that oil or water can be discharged easily. This means that, if the oil filling the sealing space B needs to be replaced, or if water has flown into the sealing space B unexpectedly and needs to be discharged, the outer oil jacket 1 is slanted to discharge the oil or water easily.

Figure 4:
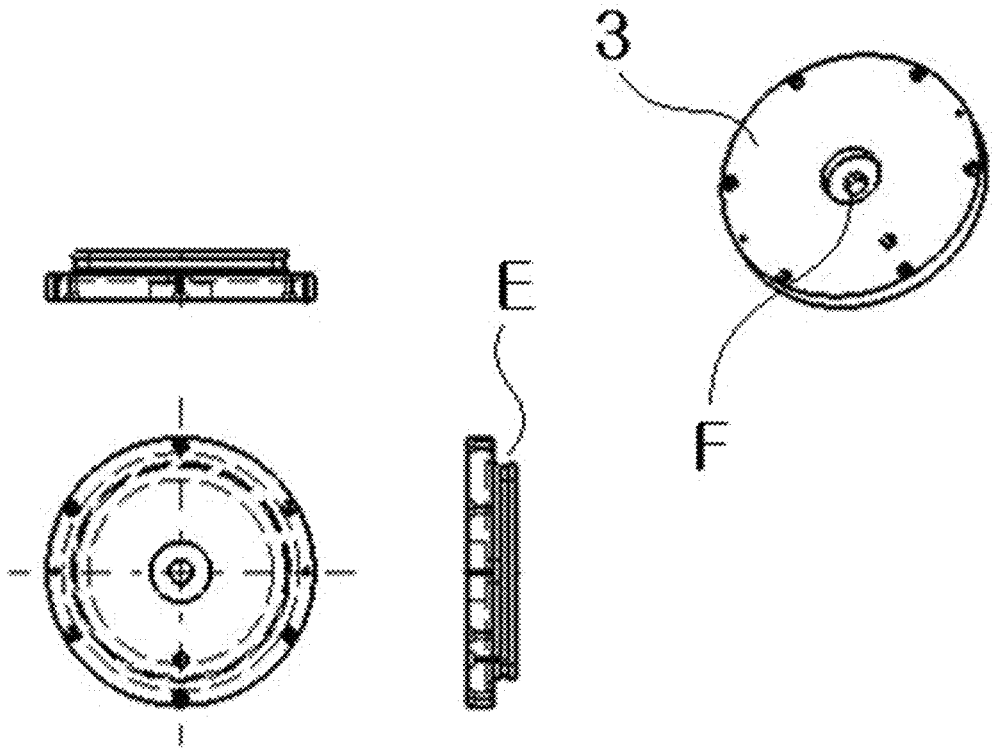
FIG. 4 illustrates the shape of an inner oil jacket.

Although inflow of water is prevented by the outer oil jacket 1, as described above, there still exists a possibility that, in the case of a mechanical device operating in deep water, high-pressure water may flow in along the rotation shaft 5. Considering this, the present invention proposes that double oil jackets be mounted, i.e. inflow of water be prevented in a double-fold manner. Specifically, the present invention proposes that, inside the sealing space B formed by the outer oil jacket 1, the inner oil jacket 3 forms an additional sealing space C surrounding the rotation shaft 5 of the motor 10 additionally. The sealing space C is filled with oil as in the case of the sealing space B. Therefore, the outer oil jacket 1 prevents the inflow of water primarily, and, if water flows into the outer oil jacket 1 anyway, the inner oil jacket 3 prevents the inflow of water secondarily. This process guarantees complete prevention of inflow of water into the body of the motor 10. The inner oil jacket 3, which is a type of cover, is provided with an oil injection hole 12 and a hole F (FIG. 4), through which the rotation shaft 5 extends, as in the case of the outer oil jacket 1. The inner oil jacket 3 also has an O-ring insertion part E (FIG. 4) formed to provide waterproofing in an emergency.

According to the present invention, snap rings 7 are fitted onto the rotation shaft 5, which extends through the outer and inner oil jackets 1 and 3, so that, even if water flows in along the shaft surface of the rotation shaft 5 unexpectedly, the snap rings 7 modify the path of inflowing water and finally prevent inflow of water into the body of the motor 10. The present invention does not specifically limit the fitting position of the snap rings 7. Considering that the inner oil jacket 3 is the final preventer of inflow of water, however, at least one snap ring 7 is preferably positioned in the sealing space C formed by the inner oil jacket 3. Furthermore, bearings 8 are preferably positioned on parts of the outer and inner oil jackets 1 and 3, through which the rotation shaft 5 extends, to reduce friction with the rotation shaft 5 and to maintain the straight shape of the rotation shaft 5 to the greatest extent.

According to the present invention, as described above, inflow of high-pressure water along the rotation shaft 5 of the motor 10 is prevented, even in the case of a mechanical device operating in deep water, thereby removing any possibility of malfunctioning or degrading of the mechanical device due to water inflow. Furthermore, the easy process of replacing the outer and inner oil jackets 1 and 3 makes maintenance and repair of the mechanical device efficient.

INDUSTRIAL APPLICABILITY

The present invention guarantees that, even in the case of a mechanical device operating in deep water, no inflow of water can cause the device to malfunction or degrade, and the maintenance and repair are efficient. Therefore, the present invention is applicable to a wide range of shipbuilding, maritime, and related mechanical fields to realize its practical and economical value.

The invention claimed is:

1. An underwater motor watertight apparatus comprising:
an outer oil jacket configured to form a first sealing space surrounding a rotation shaft of a motor; and
an inner oil jacket configured to form a second sealing space additionally surrounding the rotation shaft of the motor inside the sealing space,
wherein the first and second sealing spaces are filled with oil to prevent inflow of water into a body of the motor, and
wherein a screw thread is disposed on an inner wall surface of the outer oil jacket.

2. The apparatus as claimed in claim 1, wherein a snap ring is fitted on the rotation shaft extending through the outer and inner oil jackets.

3. The apparatus as claimed in claim 2, wherein the snap ring is positioned in the second sealing space formed by the inner oil jacket.

4. The apparatus as claimed in claim 1, wherein an oil injection hole is positioned at an outermost periphery from the center of the outer oil jacket.

5. An underwater motor watertight apparatus comprising:
an outer oil jacket configured to form a first sealing space surrounding a rotation shaft of a motor; and
an inner oil jacket configured to form a second sealing space additionally surrounding the rotation shaft of the motor inside the sealing space,
wherein the first and second sealing spaces are filled with oil to prevent inflow of water into a body of the motor, and
wherein an oil injection hole is positioned at an outermost periphery from the center of the outer oil jacket.

6. The apparatus as claimed in claim 5, wherein a snap ring is fitted on the rotation shaft extending through the outer and inner oil jackets.

7. The apparatus as claimed in claim 6, wherein the snap ring is positioned in the second sealing space formed by the inner oil jacket.

* * * * *